US011352833B2

(12) United States Patent
O'Brien

(10) Patent No.: US 11,352,833 B2
(45) Date of Patent: Jun. 7, 2022

(54) BARRIER ASSEMBLY FOR PREVENTING ITEMS FROM FALLING BEHIND DOMESTIC APPLIANCES AND A METHOD OF USING THE SAME

(71) Applicant: David James O'Brien, Wilton, CT (US)

(72) Inventor: David James O'Brien, Wilton, CT (US)

( * ) Notice: Subject to any disclaimer, the term of this patent is extended or adjusted under 35 U.S.C. 154(b) by 293 days.

(21) Appl. No.: 16/170,686

(22) Filed: Oct. 25, 2018

(65) Prior Publication Data

US 2020/0131844 A1 Apr. 30, 2020

(51) Int. Cl.

| | |
|---|---|
| ***D06F 39/12*** | (2006.01) |
| ***E06B 9/00*** | (2006.01) |
| ***D06F 58/20*** | (2006.01) |

(52) U.S. Cl.

CPC ..... *E06B 9/00* (2013.01); *D06F 39/12* (2013.01); *D06F 58/20* (2013.01)

(58) Field of Classification Search

CPC ..... E06B 9/00; D06F 58/20; D06F 39/12
See application file for complete search history.

(56) References Cited

U.S. PATENT DOCUMENTS 1,345,585 A * 7/1920 Appleman ..... B60J 3/002 296/95.1
1,378,904 A * 5/1921 Schuermann ..... G03B 15/06 160/351
1,421,039 A * 6/1922 Sweningston ..... F16P 1/02 160/351
1,952,749 A * 3/1934 Ellis ..... A47B 13/06 108/27
2,470,318 A * 5/1949 Nadelson ..... A63B 67/045 160/368.1
2,972,377 A * 2/1961 Jacobs ..... B60J 11/08 160/352
3,326,147 A * 6/1967 Toney ..... A47B 17/00 108/27
3,433,364 A * 3/1969 Tsuan-Tong ..... A47B 11/00 211/42
3,476,436 A * 11/1969 Martin ..... B60J 1/002 296/95.1
4,713,949 A 12/1987 Wilcox
4,723,583 A 2/1988 Lowe et al.
5,411,164 A 5/1995 Smith et al.
5,518,309 A 5/1996 St. Pierre
5,657,809 A * 8/1997 Longoria ..... E06B 9/04 160/160
5,758,636 A * 6/1998 Butrimas ..... F24C 15/36 126/201

(Continued)

*Primary Examiner* — Johnnie A. Shablack
(74) *Attorney, Agent, or Firm* — Dunlap Bennett & Ludwig, PLLC

(57) ABSTRACT

A barrier assembly for preventing items from falling behind domestic appliances and a method of using the same is provided. The barrier assembly provides one or more mesh nets, each mesh net extending between two pivotable columns. Each pivotal column is mounted to spaced apart surfaces along an upper periphery of an appliance. As a result, each independent mesh net may be pivoted to different angles of incident relative to the upper surface of the appliance so as to close off the space between that portion of the periphery of the appliance and an adjacent wall, preventing item from falling therein.

7 Claims, 4 Drawing Sheets

(56) References Cited

U.S. PATENT DOCUMENTS

| | | | | |
|---|---|---|---|---|
| 5,791,501 | A * | 8/1998 | Baldwin, Jr. | A47B 97/00 108/27 |
| 6,036,150 | A | 3/2000 | Lehrman | |
| 6,386,378 | B1 | 5/2002 | Scharing | |
| 6,926,060 | B2 * | 8/2005 | Mark | A63B 71/022 135/133 |
| 7,736,711 | B2 * | 6/2010 | Dobelle | A47B 95/043 428/34.1 |
| 8,671,618 | B2 * | 3/2014 | Yingst | A47F 10/06 49/152 |
| 9,565,940 | B2 | 2/2017 | Wilson et al. | |
| 9,611,578 | B2 | 4/2017 | Underly et al. | |
| 9,706,856 | B1 * | 7/2017 | Nevitt | A47D 15/00 |
| 9,751,388 | B2 * | 9/2017 | Roth | B60J 7/1856 |
| 9,920,520 | B2 * | 3/2018 | Udagawa | E04B 2/7422 |
| 10,550,634 | B1 * | 2/2020 | Holland | E06B 9/04 |
| 2009/0066206 | A1 | 3/2009 | Michelson | |
| 2010/0064543 | A1 | 3/2010 | Helot | |
| 2011/0303127 | A1 * | 12/2011 | Fryshman | A47B 83/001 108/50.11 |
| 2012/0132599 | A1 | 5/2012 | Robitaille | |
| 2012/0199048 | A1 | 8/2012 | Savalas | |
| 2012/0304896 | A1 * | 12/2012 | Webb, Sr | A47B 95/002 108/42 |
| 2014/0158024 | A1 * | 6/2014 | Henriott | A47B 3/08 108/27 |
| 2015/0203283 | A1 | 7/2015 | Speckmann | |
| 2015/0211240 | A1 | 7/2015 | Coca | |
| 2015/0321542 | A1 * | 11/2015 | Roth | B60J 7/10 160/351 |
| 2016/0374484 | A1 * | 12/2016 | Abernathy | E04H 15/005 160/351 |
| 2017/0183809 | A1 * | 6/2017 | Kazimir | D06F 39/12 |
| 2017/0245633 | A1 | 8/2017 | Heybl | |
| 2020/0131844 | A1 * | 4/2020 | O'Brien | D06F 58/20 |
| 2020/0347625 | A1 * | 11/2020 | Melic | E04G 21/3266 |

* cited by examiner

BARRIER ASSEMBLY FOR PREVENTING ITEMS FROM FALLING BEHIND DOMESTIC APPLIANCES AND A METHOD OF USING THE SAME

BACKGROUND OF THE INVENTION

The present invention relates to domestic appliance accessories and, more particularly, to a barrier assembly for preventing items from falling behind domestic appliances and a method of using the same.

Washers and dryers usually require a distance from any adjacent wall because they attach to inlet hoses and possess outlet hoses that extend from the back of the unit. The space created by this distance is where articles of clothing and other items can fall without being noticed. The only way of knowing if anything had fallen behind the washer or dryer is through moving the units or physically getting on top of them to look behind.

And even if noticed, such fallen articles and items can be difficult to retrieve because of the size and weight of the washer/dryer as well as the presence of the above-mentioned inlet and outlet hoses. Either way, one would need a grabbing device or to physically move a washer or dryer from a usually very confined space in order to get items from behind, and using devices or moving washer dryers is a time-consuming and labor-intensive process.

As can be seen, there is a need for a barrier assembly for preventing items from falling behind domestic appliances and a method of using the same. The barrier assembly provides a net-like attachment that selectively adheres along an upper periphery of the domestic appliances, thereby preventing items from falling behind them. As a result, the present invention alleviates the need to use a grabber to reach behind to retrieve items or having to move the washer and dryer, and so there is no longer a need to spend time, money or physically exert oneself. There is also less chance of a fire hazard if items are prevented from falling behind the washer or dryer.

SUMMARY OF THE INVENTION

In one aspect of the present invention, a barrier assembly for preventing items from falling behind at least one appliance includes the following: one or more mesh nets, each mesh net extending between two spaced apart pivotable columns; each pivotable column providing a mounting portion and a pivotable connection thereto; and each mounted portion mounted to one of two or more connecting points along the at least one appliance, wherein each pivotable column is selectively pivotable along an angle of incidence ranging from zero and ninety degrees relative to the respective connecting point.

In another aspect of the present invention, the barrier assembly for preventing items from falling behind at least one appliance includes the following: one or more mesh nets, each mesh net extending between two spaced apart pivotable columns, wherein each pivotable column is six to twelve inches in length; each mesh net has opposing ends, each end providing a sleeve for slidably received the pivotable column; a lower portion of each mesh net providing an adhesive for adhering to a surface of each of the at least one appliance; each pivotable column providing a mounting portion and a pivotable connection thereto; and each mounted portion providing an angled mounting plate for mounting to one of two or more connecting points along the at least one appliance, wherein each pivotable column is selectively pivotable along an angle of incidence ranging from zero and ninety degrees relative to the respective connecting point.

In yet another aspect of the present invention, a method of preventing items from falling behind at least one appliance, includes the following steps: providing the above-disclosed barrier assembly; mounting the mounting portion of each pivotable column to one or two or more connecting points along a periphery of the at least one appliance; selectively pivoting each pivotable column along an angle of incidence ranging from zero and ninety degrees relative to the respective connecting point so that an upper portion of each mesh net engages or is adjacent to a wall; and adhering a lower portion of each mesh net to a surface of the at least one appliance through application of an adhesive.

These and other features, aspects and advantages of the present invention will become better understood with reference to the following drawings, description and claims.

DETAILED DESCRIPTION OF THE INVENTION

Figure 1:
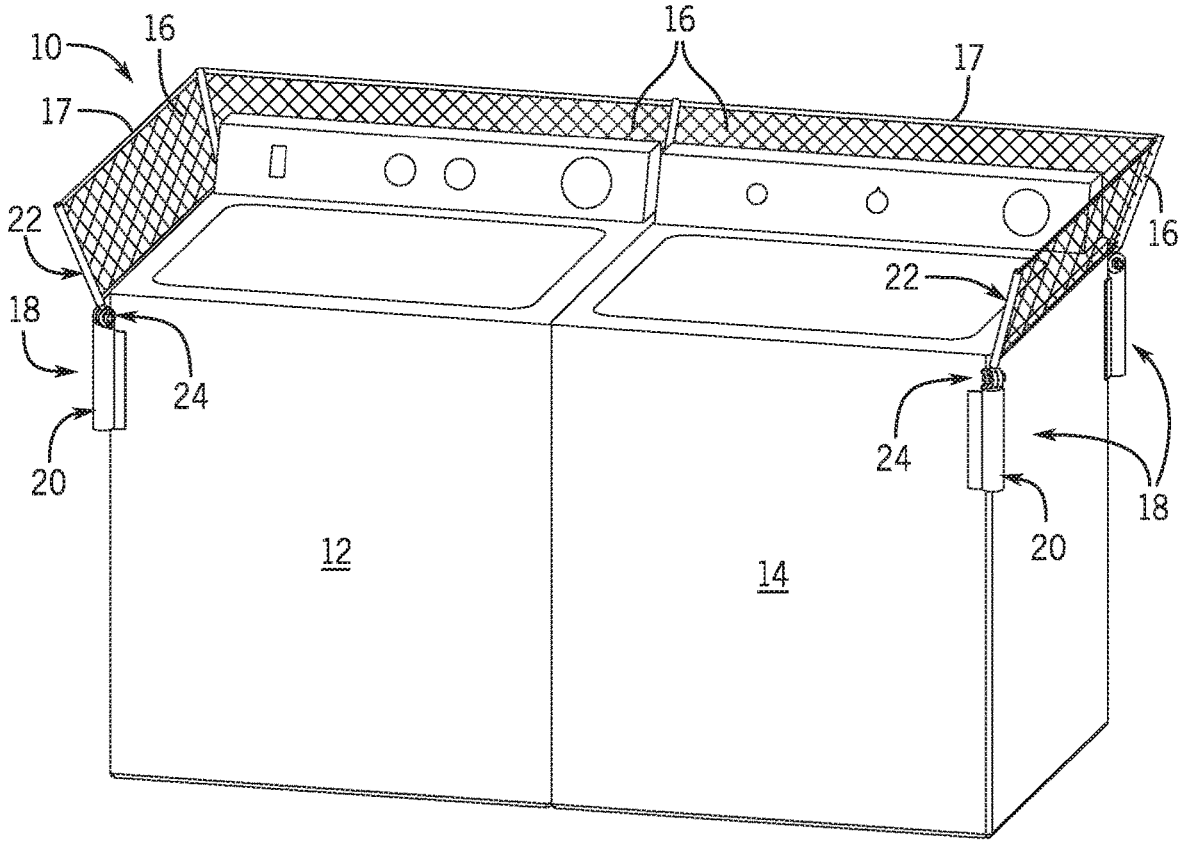
FIG. 1 is a perspective view of an exemplary embodiment of the present invention, shown in use.
Figure 2:
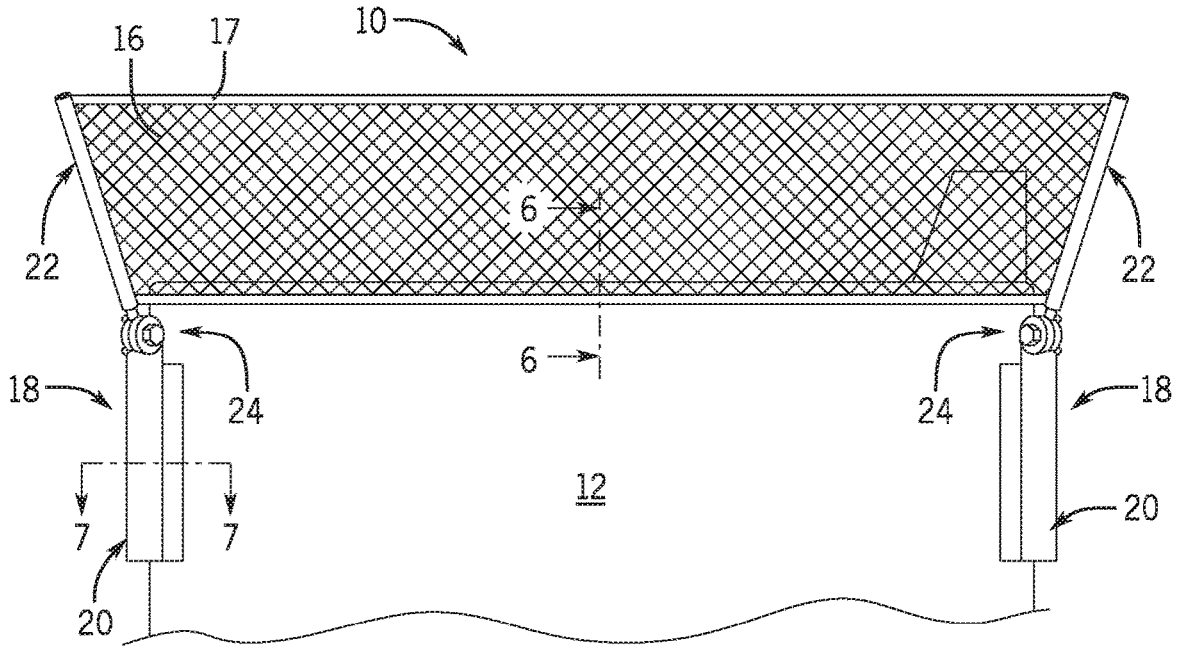
FIG. 2 is a side elevation view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a barrier assembly for preventing items from falling behind domestic appliances and a method of using the same. The barrier assembly provides one or more mesh nets, each mesh net extending between two pivotable columns. Each pivotal column is mounted to spaced apart surfaces along an upper periphery of an appliance. As a result, each independent mesh net may be pivoted to different angles of incident relative to the upper surface of the appliance so as to close off the space between that portion of the periphery of the appliance and an adjacent wall, preventing item from falling therein.

It should be understood by those skilled in the art that the use of directional terms such as upper, lower, and the like are used in relation to the illustrative embodiments as they are depicted in the figures, the upward (or upper) direction being toward the top of the corresponding figures and a downward (or lower) direction being toward the bottom of the corresponding figures.

Referring to FIGS. 1 through 7, the present invention may include a barrier assembly 10 for preventing items from falling behind domestic appliances 12 and 14 and a method of using the same. It is to be understood that though the illustrations only show a washer 12 and a dryer 14, the present invention may be used for various domestic appliances, including refrigerators, large coolers or freezers, and really any sort of stationary or difficult-to-move equipment required to be spaced apart from a neighboring wall.

The barrier assembly 10 embodies one or more elongated mesh nets 16, each mesh net 16 extending between adjacent yet spaced apart pivotal columns 22. The upper and lower portions of the mesh net 16 may be bounded by a horizontal member 17 that also extends between the spaced apart pivotal columns 22. The lower horizontal member(s) 17 may provide an adhesive 17*a* (such as tape) so that the lower portion of the mesh net 16 may be secured along an upper surface of the appliance 12/14, as illustrated in FIG. 3.

Figure 3:
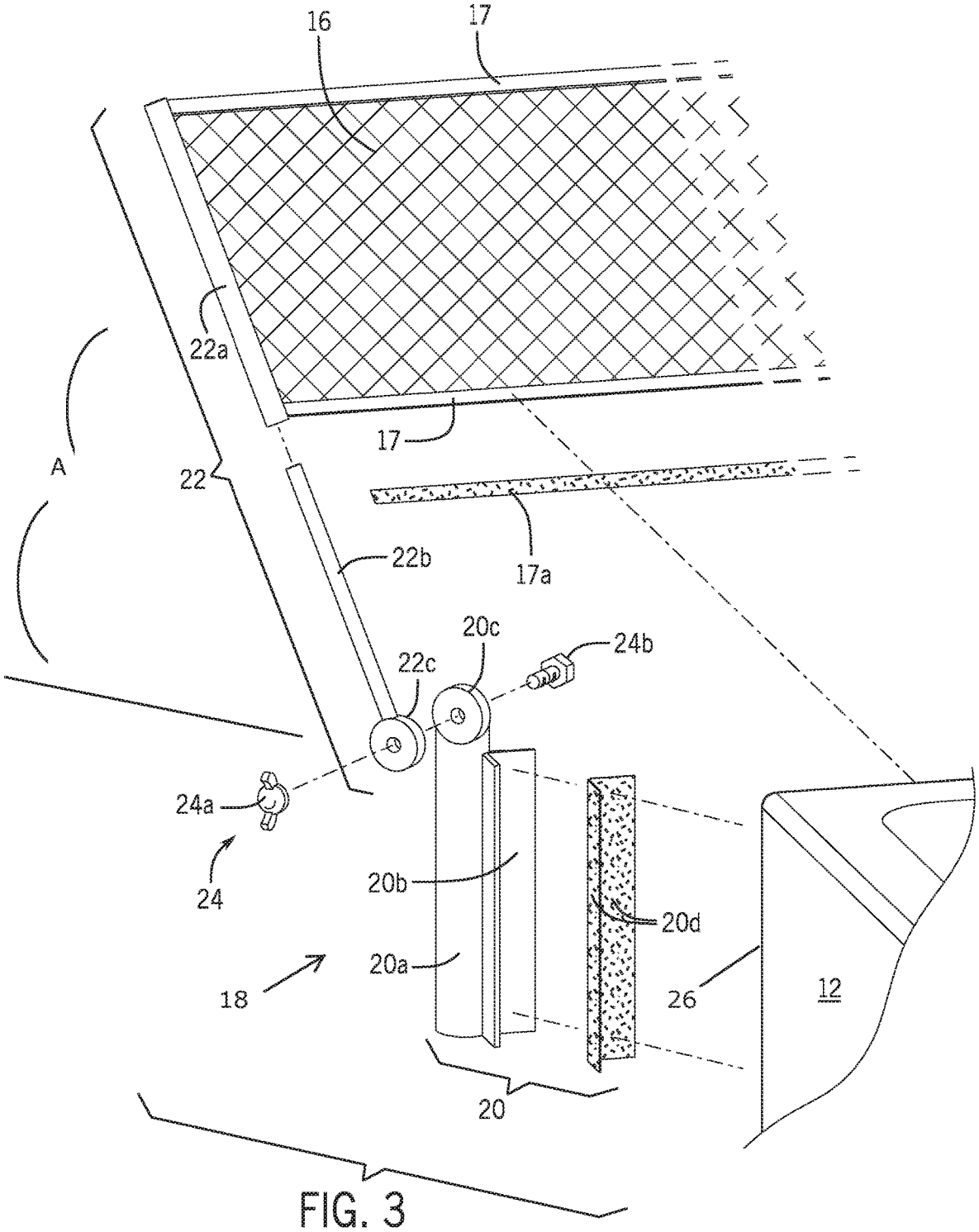
FIG. 3 is an exploded detail view of an exemplary embodiment of the present invention.
Figure 4:
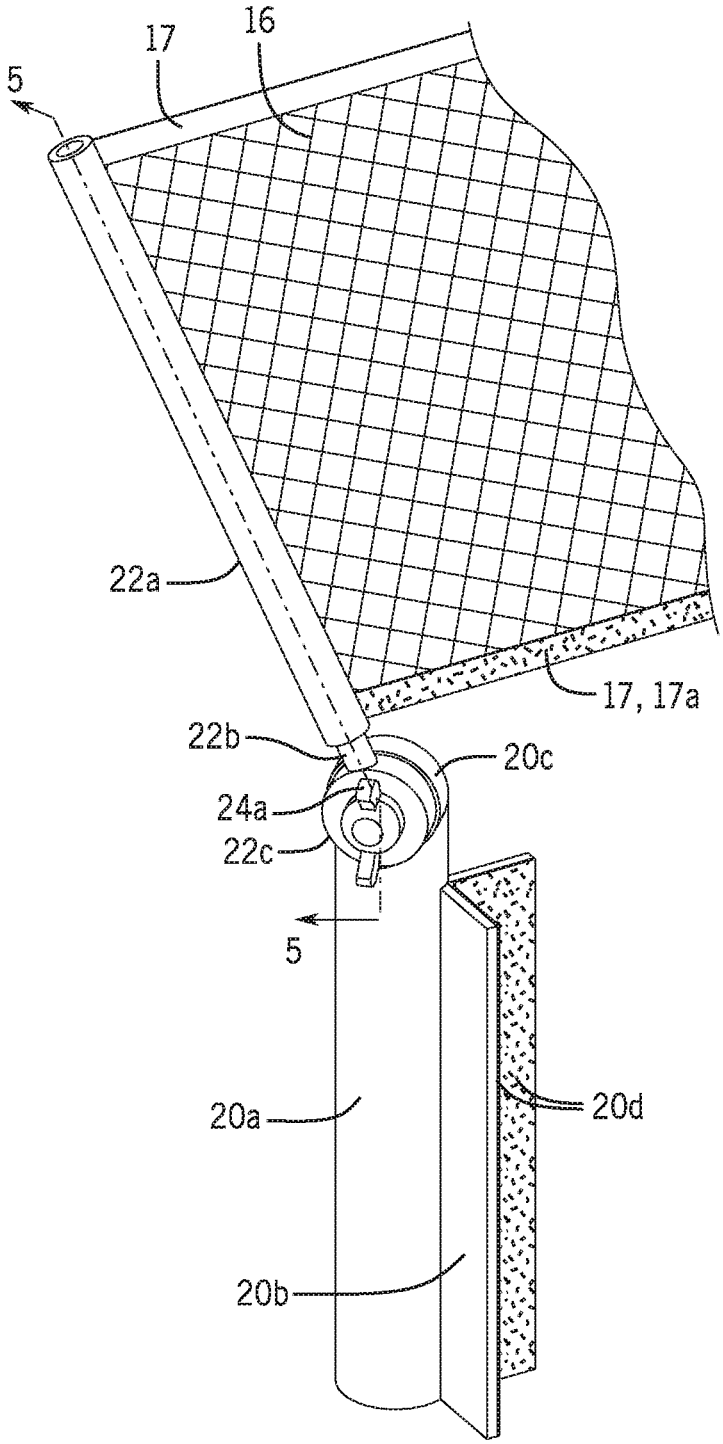
FIG. 4 is a detail perspective view of an exemplary embodiment of the present invention.
Figure 5:
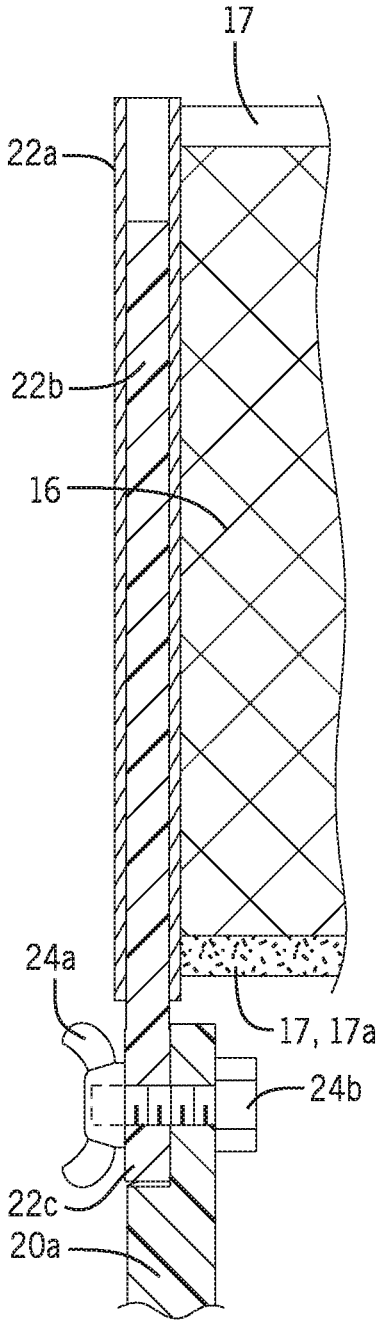
FIG. 5 is a cross-sectional view of an exemplary embodiment of the present invention, taken along line 5-5 in FIG. 4.
Figure 7:
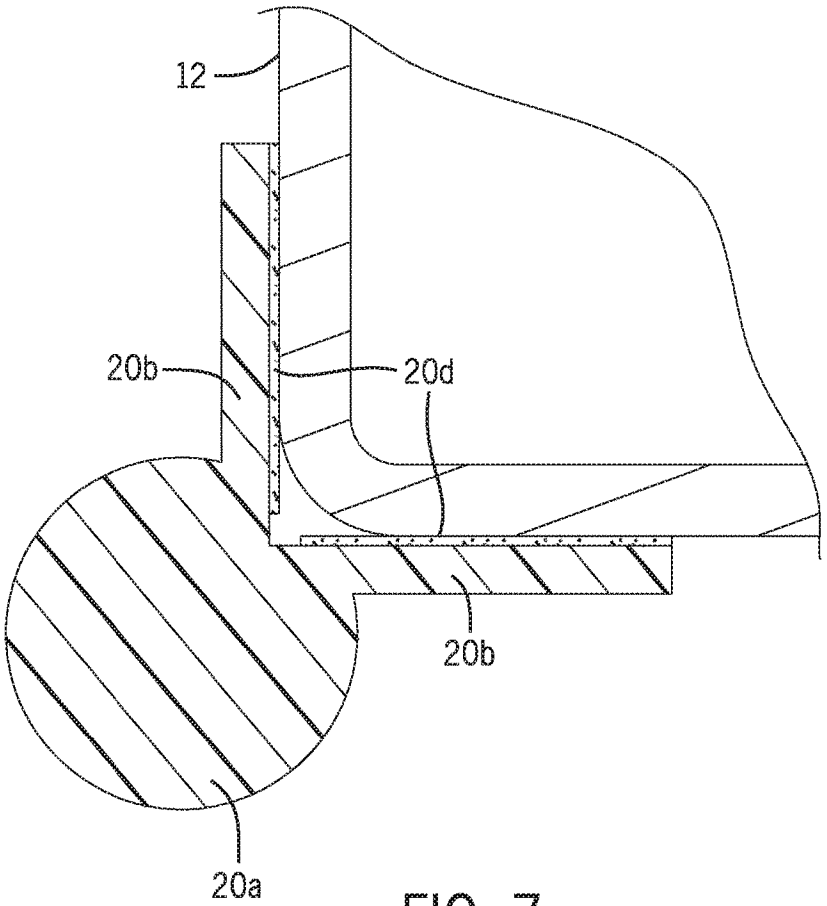
FIG. 7 is a cross-sectional view of an exemplary embodiment of the present invention, taken along line 7-7 in FIG. 2.
Figure 6:
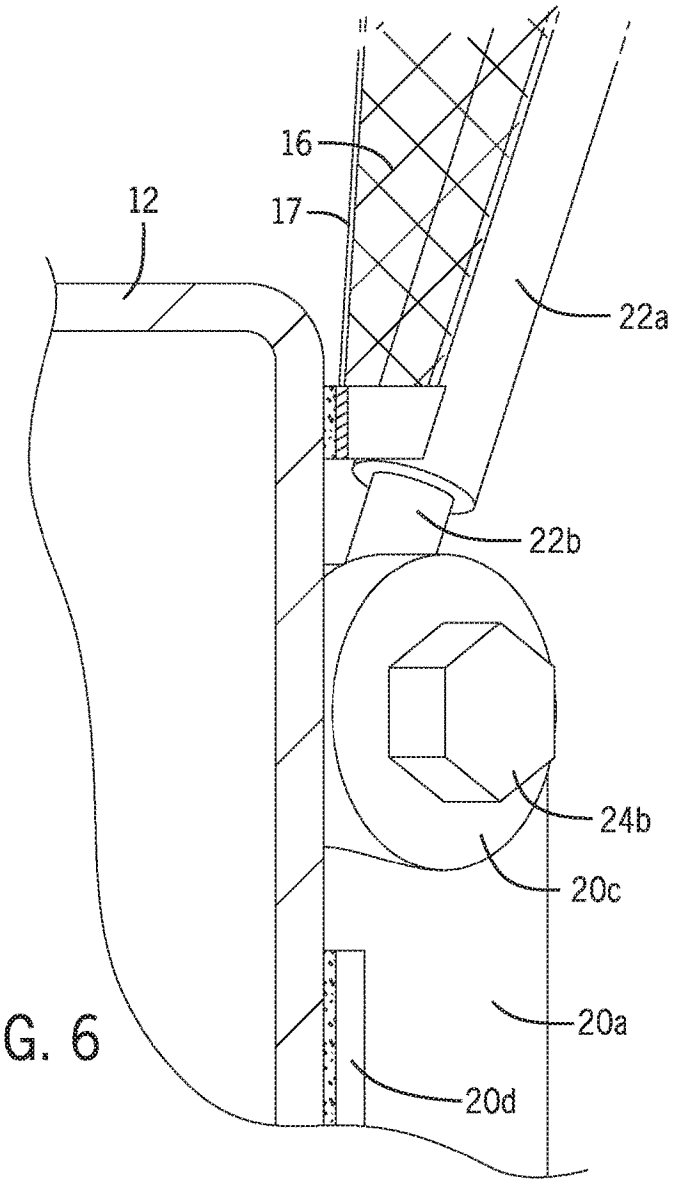
FIG. 6 is a detail perspective view of an exemplary embodiment of the present invention, taken along line 6-6 in FIG. 2.

Each mesh net 16 may provide a sleeve 22*a* on each opposing end of their typically elongated length, as illustrated in FIGS. 3 through 5 each sleeve 22*a* is oriented transverse to said elongated length. The sleeves 22*a* may be made of fabric or other flexible material. Each sleeve 22*a* is dimensioned and adapted to slidably receive a shaft portion 22*b* of one of the pivotal columns 22. The shaft portion 22 may be six to twelve inches in length. The sleeve 22*a* may slide over a distal end of the shaft portion 22*b*, as illustrated in FIG. 3. The proximal end of the shaft portion 22*b* includes a first pivotal attachment 22*c* for providing a pivotably connection 24 with a mounting portion 18.

The mounting portion 18 may provide a second pivotal attachment 20*c* along a distal end thereof for forming the pivotal connection 24. In certain embodiments, the first and second pivotal attachments 22*c* and 20*c* may each provide a pivot hole that operatively align and receives a second pivotal fastener 24*b*, which in turn engages a first pivotal fastener 24*a* for providing the pivotal connection 24. In some embodiments the first and second pivotal fastener 24*a* and 24*a* may be a wingnut 24*a* and a bolt 24*b*, respectively. The mounting portion 18 and pivotal connecting shaft 22*b* may be made of various plasticized materials or other material that can take repeated bending without fracture as well as be amendable to manufacture through injection molding or additive manufacture.

Each pivotal connection 24 enables each associated pivotal column 22 to pivot across a range of angles of incidence A (see FIG. 3) relative to a connecting point 26 of domestic appliances 12 and 14. The pivotal column 22 may be angled at approximately 80 degrees towards a wall to lean against it, thereby allowing the attached mesh net 16 to "catch" items—i.e., preventing said items from falling behind the associated appliance 12/14. Each mounting portion 18 provides a lower portion 20 including having a shaft 20*a* extending from the second pivotal attachment 20*c*. A mounting plate 20*b* may be attached to the shaft 20*a*. An adhesive substance 20*d* may be applied to the mounting plate 20*b* for securing to a surface or the connecting point 26 along the domestic appliance 12 or 14. In certain embodiments, the mounting plate 20*b* may be angled (or be an angle) to conform to a corner of the domestic appliance 12 or 14, as illustrated in FIG. 3.

A method of using the present invention may include the following. The barrier assembly 10 disclosed above may be provided. A user of appliances 12 and 14 may attach two or mounting portions 18 along two or more connecting points 26 along one or more appliances 12 and/or 14. Typically, the mounting plates 20*b* would engage corners of the appliances 12, 14, through need not to as the mounting plate 20*b* may be planar. Moreover, each mesh net 16 may act independently of each other, and so be pivoted to different angels of incidences (A) that an adjacent mesh net 16.

The user may also adhere the adhesive 17*a* of the horizontal member(s) 17 along a surface of the appliance 12,14 so there is no space between said surface and the mesh net 16. As a result of installing the barrier assembly along a periphery of the appliance(s) 12,14 the chances of items falling unnoticed behind the appliances 12,14 is significantly reduced.

It should be understood, of course, that the foregoing relates to exemplary embodiments of the invention and that modifications may be made without departing from the spirit and scope of the invention as set forth in the following claims.

What is claimed is:

1. A barrier assembly for preventing items from falling beyond a horizontal surface of a stationary appliance, comprising:

a plurality of mesh nets, each mesh net extending between two spaced apart pivotable columns;

each pivotable column comprising:

a shaft having a shaft pivotable attachment point at a proximal end of the shaft;

a mounting portion;

and a pivotable connection between the shaft and the mounting portion, wherein each pivotable column is pivotable along a range of angle of incidences relative to the pivotable connection;

each mounting portion comprises:

an angled plate having a first portion and a second portion orthogonal joined to the first portion;

a mounting adhesive along the first and second portions;

the mounting adhesive connecting the mounting portion to a corner of the stationary appliance below the horizontal surface, wherein the first portion connects to a first vertical surface of the stationary appliance, wherein second portion connects to a second vertical surface of the stationary appliance, and wherein the first vertical surface is orthogonal relative to the second vertical surface; and a mounting pivotable attachment point spaced apart from the stationary appliance;

each pivotable connection comprises the mounting pivotable attachment point and the shaft pivotable attachment point interconnected by a pivotal fastener in such a way so that each pivotable column is selectively fixable between the opposing bounds of said range.

2. The barrier assembly of claim 1, wherein each pivotable column is six to twelve inches in length.

3. The barrier assembly of claim 1, wherein each mesh net has opposing ends, each end having a sleeve slidably receiving the pivotable column.

4. The barrier assembly of claim 1, wherein a lower portion of each mesh net provides an adhesive for adhering to a surface of each of the at least one appliance.

5. A method of preventing items from falling beyond a horizontal surface of a stationary appliance using the barrier assembly of claim 1, comprising the steps of:

adhering the mounting portion of each pivotable column to a respective corner of the stationary appliance so that the pivot point is spaced apart from the stationary appliance, wherein each respective corner is vertically downward of said horizontal surface;

selectively pivoting each pivotable column along an angle of incidence ranging from zero and ninety degrees relative to the pivotable connection until reaching a wall angle of incidence wherein an upper portion of each mesh net engages or is adjacent to a wall; and fixing, by way of the pivotal fastener, each pivotable column at the wall angle of incidence.

6. The method of claim 5, further comprising adhering a lower portion of each mesh net to a surface of the at least one appliance through application of an adhesive.

7. A barrier assembly for preventing items from falling beyond a horizontal surface of a stationary appliance, comprising:

two or more mesh nets, each mesh net extending between two spaced apart pivotable columns;

each pivotable column providing a mounting portion and a pivotable connection thereto;

each mounted portion comprises:

an angled plate having a first portion and a second portion joined thereto;

a mounting adhesive along the first and second portions;

the mounting adhesive connecting the mounting portion to a corner of the stationary appliance below the horizontal surface, wherein the first portion connects to a first vertical surface of the stationary appliance; and a mounting pivotable attachment point spaced apart from the stationary appliance;

wherein each pivotable column is pivotable along a range of angle of incidences relative to a respective connecting point; and a pivotal fastener operatively associated with the pivotable connection in such a way so that each pivotable column is selectively fixable between the opposing bounds of said range.

* * * * *